US005697170A

United States Patent [19]

Murrell et al.

[11] Patent Number: 5,697,170

[45] Date of Patent: Dec. 16, 1997

[54] AIR COOLED SHOE

[75] Inventors: Mark D. Murrell, Coppell; Rusty A. Reed, Grand Prairie, both of Tex.

[73] Assignee: Mark A. Murrell, Coppell, Tex.

[21] Appl. No.: 648,861

[22] Filed: May 16, 1996

Related U.S. Application Data

[63] Continuation of Ser. No. 325,678, Oct. 19, 1994, abandoned.

[51] Int. Cl.[6] ..... A43B 7/06

[52] U.S. Cl. ..... 36/3 B; 36/29

[58] Field of Search ..... 36/3 R, 3 B, 3 A, 36/29, 28

[56] References Cited

U.S. PATENT DOCUMENTS

| | | | |
|---|---|---|---|
| 426,495 | 4/1890 | Falkner . | |
| 655,576 | 8/1900 | Pearson | 36/3 R |
| 890,966 | 6/1908 | Critz, Jr. | 36/3 R |
| 940,856 | 11/1909 | Critz, Jr. . | |
| 1,364,226 | 1/1921 | Wherry . | |
| 1,660,698 | 2/1928 | Williams, Sr. | 36/3 R |
| 2,329,573 | 9/1943 | Ziegliss . | |
| 2,354,407 | 7/1944 | Shaks . | |
| 2,751,692 | 6/1956 | Cortina . | |
| 3,331,146 | 7/1967 | Karras | 36/3 R |
| 3,533,171 | 10/1970 | Motoki | 36/3 B |
| 3,791,051 | 2/1974 | Kamimura | 36/3 B X |
| 3,973,336 | 8/1976 | Ahn | 36/3 B |
| 4,420,893 | 12/1983 | Stephan . | |
| 4,776,110 | 10/1988 | Shuang | 36/3 B |
| 4,999,932 | 3/1991 | Grim | 36/3 B |
| 5,068,981 | 12/1991 | Jung . | |
| 5,179,792 | 1/1993 | Brantingham | 36/3 B X |
| 5,224,277 | 7/1993 | Do . | |
| 5,233,767 | 8/1993 | Kramer . | |
| 5,295,313 | 3/1994 | Lee . | |
| 5,341,581 | 8/1994 | Huang | 36/3 B |
| 5,375,345 | 12/1994 | Djuric | 36/3 R |
| 5,408,760 | 4/1995 | Tse et al. | 36/3 B |

FOREIGN PATENT DOCUMENTS

| | | | |
|---|---|---|---|
| 640720 | 1/1937 | Germany | 36/3 R |
| 2193080 | 2/1988 | United Kingdom | 36/3 R |
| 2240254 | 7/1991 | United Kingdom | 36/3 B |
| 2262024 | 6/1993 | United Kingdom | 36/3 B |

*Primary Examiner*—B. Dayoan

*Attorney, Agent, or Firm*—Gregory M. Howison; Joseph Shallenburger

[57] ABSTRACT

A ventilated shoe for ventilating the foot is disclosed. The ventilated shoe contains an outer sole (14). A heel pad (16) is disposed at the rear end of the outer sole (14). An intake manifold (26) is disposed near the front of the outer sole (14). The intake manifold (26) is connected to pump cells (20), (22) and (24). An exhaust manifold (46) is also connected to pump cells (20), (22) and (24). The intake manifold (26) only allows air to flow through the manifold (26) into the pump cells (20), (22) and (24). The exhaust manifold (46) only allows air to flow out of the manifold (46) from the pump cells (20), (22) and (24). The pump cells (20), (22) and (24) are filled with an open-celled foam (70) so that when no pressure is being applied to the pump cells (20), (22) and (24), they draw air in through the intake manifold (26). When pressure is applied to the pump cells (20), (22) and (24), the open-celled foam (70) is compressed and the air is expelled through the exhaust manifold (46).

9 Claims, 4 Drawing Sheets

AIR COOLED SHOE

This application is a continuation of application Ser. No. 08/325,678, filed Oct. 19, 1994, now abandoned.

TECHNICAL FIELD OF THE INVENTION

The present invention relates to a ventilated shoe and, more particularly, to a shoe having an air-pumping device to ventilate the shoe.

BACKGROUND OF THE INVENTION

Presently known ventilated shoes comprise elastomeric and resilient pads which are made of soft materials, such as sponge or rubber, and contain a plurality of holes in the sole and in the heel of the shoe in order to increase foot comfort. In these types of insoles, it is very difficult to remove moisture and the odor produced as a result of moisture which collects in the shoe due to foot sweating caused by poor shoe ventilation. Since most people use their shoes for long periods of time, it is essential to properly maintain and ventilate the shoes in order to avoid foot diseases, such as, for example, water-eczema.

According to a report of the American Podiatry Association, 75 percent of the males and females stand or walk for 4 hours a day. Such foot stress leads to foot problems, particularly in males, where athlete's foot fungi and the odor associated therewith have become a common problem.

SUMMARY OF THE INVENTION

The present invention disclosed and claimed herein comprises an air-cooled shoe operable to ventilate the interior of the shoe and the area around a human foot. An outer sole having a toe portion, a ball portion and a heel portion is provided. A shoe upper formed above the outer sole and attached to the outer sole is provided. A pump array is disposed above the ball portion of the outer sole, the pump array including an air-tight pump cell defined by a flexible material and filled with an open cell material which causes the pump cell to expand and fill with air, the pump cell having an air intake disposed on the toe portion of the outer sole and an air exhaust connected to the outside ambient air. A semi-rigid layer is disposed over the entirety of the pump array.

In another aspect of the present invention, a pump lever is disposed over the pump array, the pump lever being fixed to the outer sole at the rear of the outer sole. Pump return springs are disposed at the front of the pump lever between the pump lever and the outer sole to push the pump lever up and allow the pump cell to fill with air.

In a further aspect of the present invention, an air-cooled shoe insert operable to ventilate the interior of a shoe and the area around a human foot is disclosed. The insole has a toe portion, a ball portion and a heel portion. A pump array is disposed above the ball portion of the insole, the pump array includes an air-tight pump cell defined by a flexible material and filled with an open cell material which causes the pump cell to expand and fill with air, the cell having an air intake disposed on the toe portion of the outer sole and an air exhaust. A secondary bladder is disposed behind the pump cell to expel air drawn from the pump array through the exhaust and into the outside ambient air.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1A:
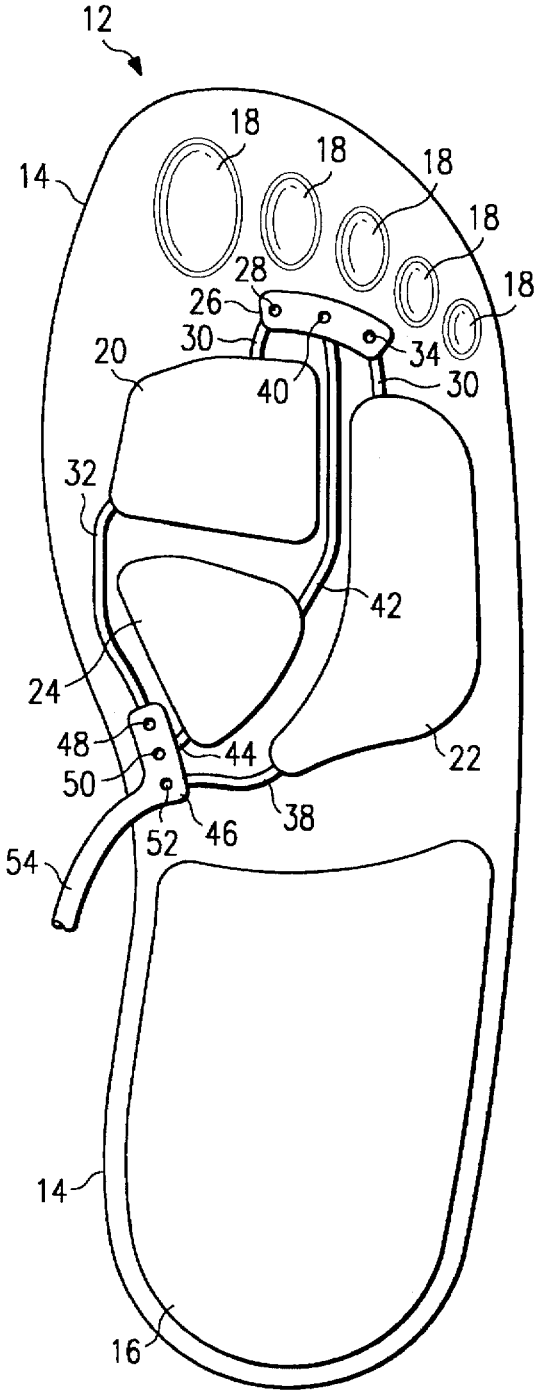
FIG. 1*a* illustrates a cut-away view of the system of the present invention.

Referring now to FIG. 1*a*, there is illustrated a cut-away view of the system of the present invention. A sole 12 is provided as part of an overall shoe (not shown). An outer sole 14 is provided and is roughly in the shape of a human foot (not shown), which fits over the top of the sole 12. A heel pad 16 is disposed on the top of the outer sole 14 and covers the rear one-third area of the outer sole 14. Toe impressions 18 are provided at the front edge of the outer sole 14. The toe impressions 18 are slightly impressed areas of the outer sole 14 and are placed to coincide at the locations of the toes of a human foot (not shown), when placed over the sole 12. A front pump cell 20 is provided and is placed on top of the outer sole 14, such that it corresponds to the head of the metatarsus of the first shaft of the human foot and of the second shaft of the human foot, extending approximately half-way up the first and second shafts from the head towards the base. A right pump cell 22 is provided and placed above the outer sole 14. The right pump cell 22 corresponds to the area between the head and the base of the metatarsus of the third, fourth and fifth shaft. A rear pump cell 24 is provided and placed on top of the outer sole 14. The location of the rear pump cell 24 corresponds to the location of the base of the metatarsus of the first and second shaft to mid-way between the base and the head of the metatarsus of the first and second shaft.

An intake manifold 26 is provided and located between the toe impressions 18 in the front of the front pump cell 20 and the right pump cell 22. The intake manifold 26 is located such that it coincides the phalanges of the first through fifth shaft of the human foot. A front intake reed 28 is provided on the left side of the intake manifold 26 and is connected through a front intake tube 30 to the front pump cell 20. A rear intake reed 40 is provided in the center of the intake manifold 26 and is connected by a rear intake tube 42 to the rear pump cell 24. A right intake reed 34 is provided on the right side of the intake manifold 26 and is connected by the right intake tube 36 to the right pump cell 22. The intake reeds 28, 40 and 34 allow air to flow only in one direction into the pump cells 20, 22 and 24. An exhaust manifold 46 is provided and placed on the outer sole 14 of the sole 12. The exhaust manifold 46 is located under the arch of the human foot. Located on the upper portion of the exhaust manifold 46 is a front exhaust reed 48. The exhaust reed 48 is connected to the front pump cell 20 by a front exhaust tube 32. Located in the center of the exhaust manifold 46 is a rear exhaust reed 50. The rear exhaust reed 50 is connected to the rear pump cell 24 by a rear exhaust tube 44. Located on the lower portion of the exhaust manifold 46 is a fight exhaust reed 52. The fight exhaust reed 52 is connected to the right pump cell 22 by a fight exhaust tube 38. The exhaust reeds 46, 50 and 52 allow air to pass through them in only one direction, that is, from the exhaust tubes 32, 44 and 38. The exhaust manifold 46 has one outlet into the outside air which is connected to a tube 54 to pass through the outer sole 14 of the sole 12.

Figure 1B:
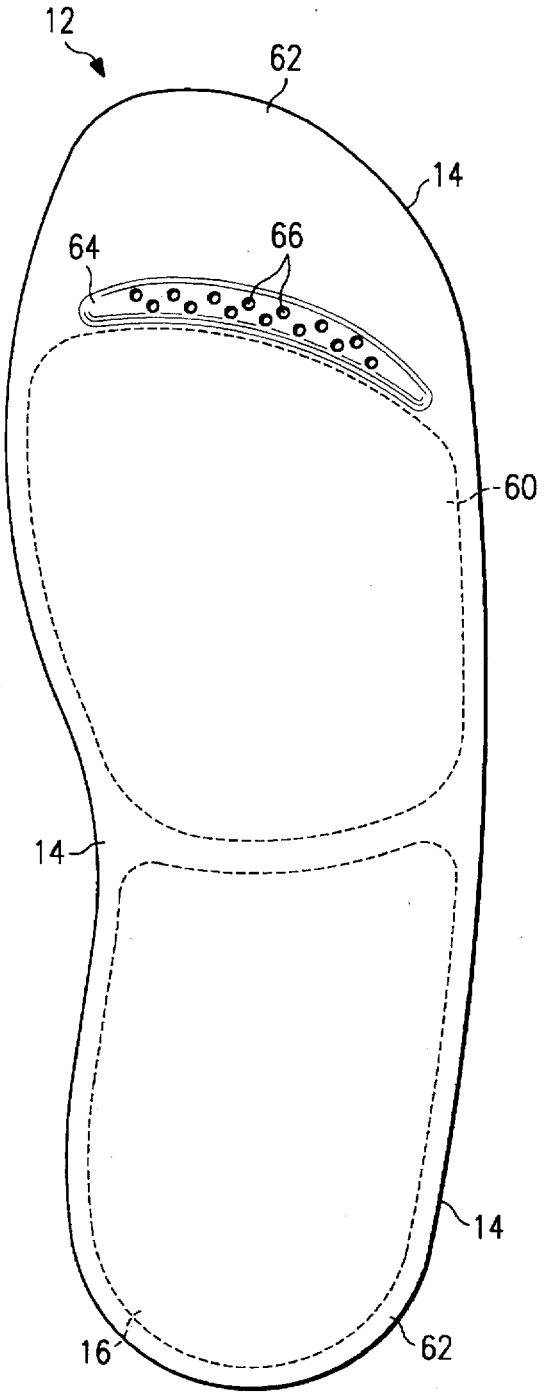
FIG. 1*b* illustrates a top view of the system of the present invention.

Referring now to FIG. 1*b*, there is illustrated a top view of the sole 12. The top layer of the sole 12 is a pad 62 running the full length of the sole 12 covering the outer sole 14. This pad 62 is the same shape as the outer sole 14. A semi-rigid layer 60 is located just beneath the pad 62 in an area covering the pump cells (not shown). A raised area 64 is located on the top of the pad 62 and coincides with an area just under the base of the phalanges of the first through the fifth shaft of the toes of the human foot. Disposed in the raised area 64 are intake holes 66. These holes perforate the pad 62 to allow air to pass from the air around the foot through the intake holes 66 to the intake manifold 26 (not shown) located just beneath the intake holes 66. The semi-rigid layer 60 is used to support the foot while allowing the foot to press down against the pump cells (not shown). The heel pad 16 is shown underneath the pad 62.

Figure 1C:
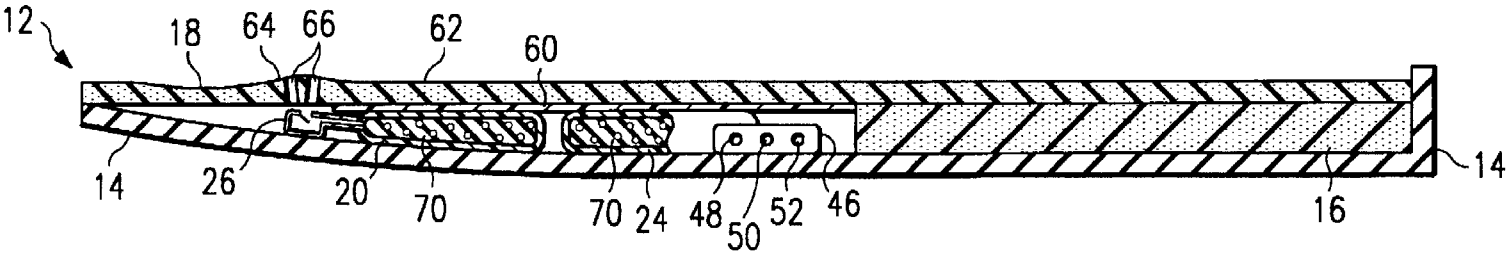
FIG. 1*c* illustrates a side cross-sectional view of the system of the present invention.

Referring now to FIG. 1*c*, there is illustrated a cross-sectional view of the system of the present invention. The outer sole 14 is shown extending from the rear of the shoe across the bottom of the rear of the sole 12 running the full length of the sole 12. The heel pad 16 is shown passing from the rear of the outer sole 14 one-third length of the outer sole 14. The exhaust manifold 46 is shown containing the front exhaust reed 48, the rear exhaust reed 50 and the right exhaust reed 52. The rear pump cell 24 is shown as is the front pump cell 20. The intake manifold 26 is shown. Placed above the front air cell 20 and the rear air cell 24, the semi-rigid layer 60 runs from the front pump cell 20 to the rear of the exhaust manifold 46. Covering the full length of the sole 12 from the rear of the heel pad 16 to the front of the outer sole 14 is the pad 62. The toe impressions 18 are shown disposed in the pad 62. The raised area 64 is shown just behind the toe impressions 18. The intake holes 66 are shown perforating the pad 62 and disposed in the area of the raised area 64. The intake holes 66 are also disposed just above intake manifold 26. Also shown is the open-celled foam 70 located inside the front pump cell 20 and the rear pump cell 24.

Figure 1D:
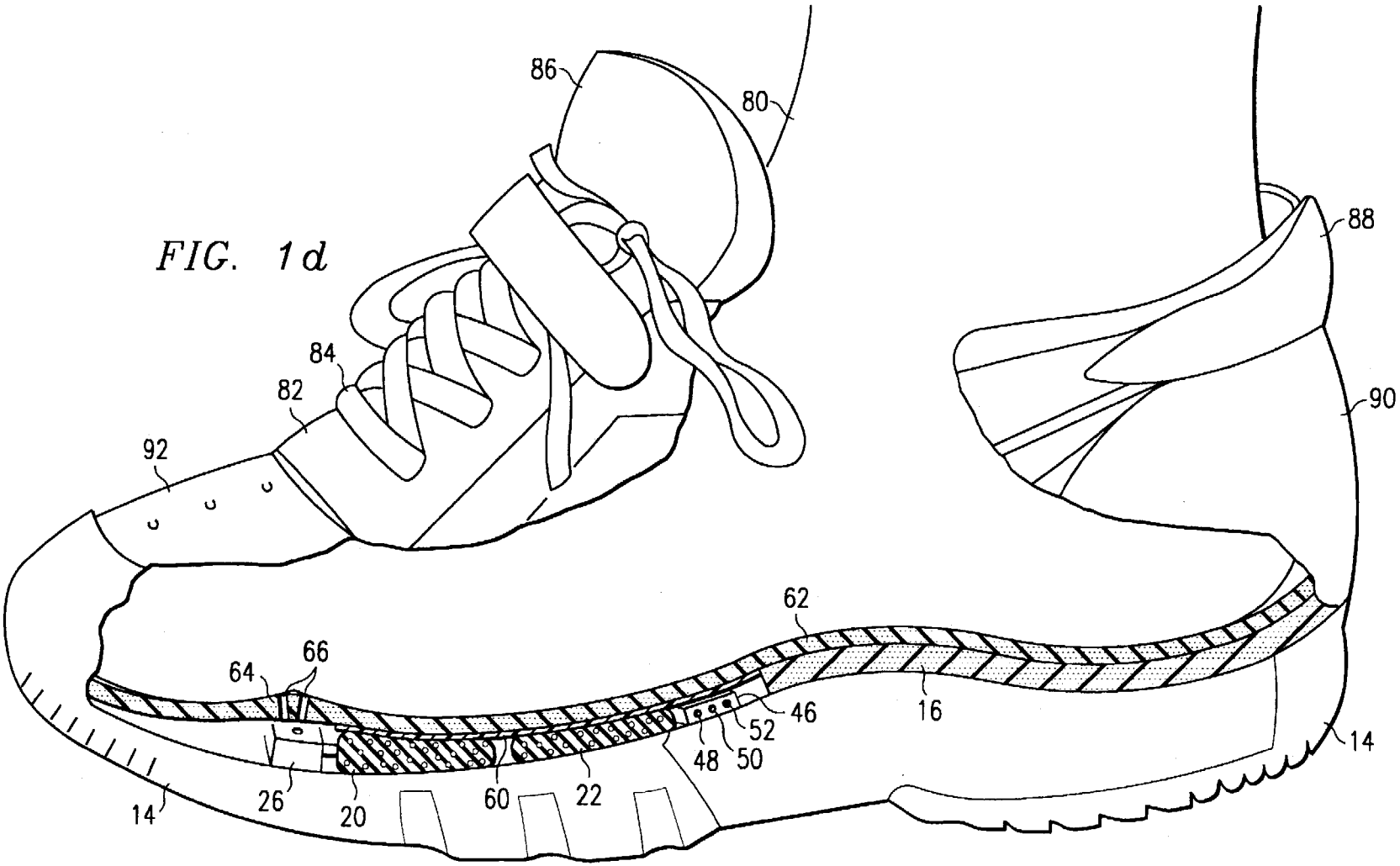
FIG. 1*d* illustrates a side cut-away view of the system of the present invention.

Referring now to FIG. 1*d*, them is illustrated a side cut-away view of the system of the present invention. The outer sole 14 is shown running from the front of the human foot to the rear of the human foot 80. A typical tennis shoe upper 82 is shown connected to the outer sole 14. The tennis shoe upper contains laces 84, a tongue 86, a collar 88 and a body 90. The shoe has vents 92 placed in the toe area. The pad 62 is shown running from the heel of the foot 80 to the toes of the foot 80. The raised area 64 is shown positioned under the base phalanges of the foot 80. Intake holes 66 are shown disposed in the pad 62 at the raised area 64. The intake manifold 26 is shown disposed directly beneath the intake holes 66. The front pump cell 20 is shown disposed directly in front of the rear pump cell 22. The exhaust manifold 46 is shown having the front exhaust reed 48, the rear exhaust reed 50 and the right exhaust reed 52 disposed therein. The heel pad 16 is shown disposed between the foot 80 and the outer sole 14. The semi-rigid layer 60 is shown disposed between the pad 62 and the front pump cell 20 and the rear pump cell 24.

In operation, the human foot (not shown) fits over the sole 12. The human foot is outlined by the outer sole 14. The heel of the human foot fits over the heel pad 16 with the five toes of the human foot each fitting into the toe impressions 18. The front intake reed 28, the rear intake reed 40 and the right intake reed 34 allow only air to pass one way from the interior of the shoe into the tubes 30, 42 and 36. The front exhaust 48, the rear exhaust reed 50 and the right exhaust reed 52 also only allow air to pass one way, that being from the exhaust tubes 32, 38 and 44 through the outside exhaust tube 50. Therefore, when the pressure of the foot (not shown) is not pressing on the front pump cell 20, the fight pump cell 22 and the rear pump cell 24, the open-celled foam 70 inside the pump cells 20, 22 and 24 causes the pump cells 20, 22 and 24 to expand, thereby drawing air through the intake manifold 26 and through the intake reeds 28, 40 and 34 through the intake tubes 30, 42 and 36 and into the pump cells 20, 22 and 24. This draws air from the interior of the shoe and around the foot into the front pump cell 20, the rear pump cell 24 and the right pump cell 22.

When a person steps with their foot onto a surface, the foot then presses down on the pad 62 and the foot presses down on the front pump cell 20, the right pump cell 22 and the rear pump cell 24. This compresses the pump cells 20, 22 and 24 and compresses the open-celled foam 70 inside the pump cells 20, 22 and 24. This in turn causes the air from the front pump cell 20 to be expelled through the front exhaust tube 32, through the exhaust reed 48 and thereby through the outside exhaust tube 54. This also causes air from the right pump cell 22 to be expelled through the right exhaust tube 38 and through the right exhaust reed 52 through the outside exhaust tube 54. Finally this causes air inside the rear pump cell 24 to be expelled through the tube 44 and thereby through the rear exhaust reed 50 and through the outside exhaust tube 54 into the outside ambient air. This happens with each step.

After a person lifts their foot off the ground to take another step, the air is drawn through the intake reed 28, 40 and 34 through the intake tubes 30, 36 and 42 and into the pump cells 20, 22 and 24. Air is only drawn through the intake reeds 28, 30 and 44 and not through the exhaust reeds 48, 50 and 52 because air can only be expelled out of the exhaust reeds 48, 50 and 52 in the direction of the outside exhaust tube 54 from the pump cells 20, 22 and 24. Once the pump cells 20, 22 and 24 are filled with air when a person steps onto a surface, the foot presses down on the pump cells 20, 22 and 24, pressing them against the outer sole 14 of the sole 12, causing the pump cells 20, 22 and 24 to be compressed and the air to be expelled through the tubes 32, 42 and 38 and thereafter through the exhaust reeds 48, 50 and 52 and through the outside exhaust tube 54 into the outside ambient air.

This system comprising multiple pump cells 20, 22 and 24 and multiple intake reeds 28, 34 and 40 provides consistent air transfer during changing foot positions and waiting due to the multiple pump cells 22, 24 and 20 and the semi-rigid layer 60 placed over the pump cells 20, 22 and 24. Since the pump cells 20, 22 and 24 each have individual intake reeds 28, 40 and 34, individual intake tubes 30, 42 and 36, individual exhaust tubes 32, 44 and 38 and individual exhaust reeds 48, 50 and 52, this allows the individual pump cells 20, 22 and 24 to operate independently from each other. This also causes increased service life due to the fact that the failure of the exhaust reeds 46, 50 and 52 is the most probable cause of system malfunction. Since each pump cell 20, 22 and 24 has its own exhaust reed 46, 50 and 52, the rate of reduction is fractional, since it is unlikely that all the exhaust reeds 46, 50 and 52 will fail simultaneously.

Figure 2B:
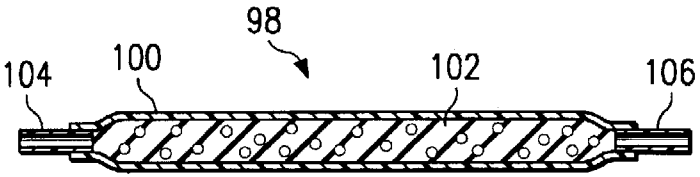
FIG. 2*b* illustrates a cross-sectional view of an assembled pump cell.
Figure 2C:
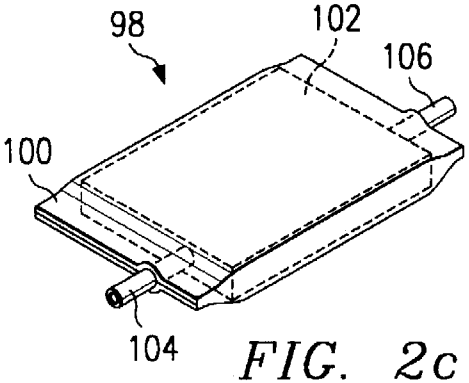
FIG. 2*c* illustrates a perspective view of the pump cell.
Figure 2A:
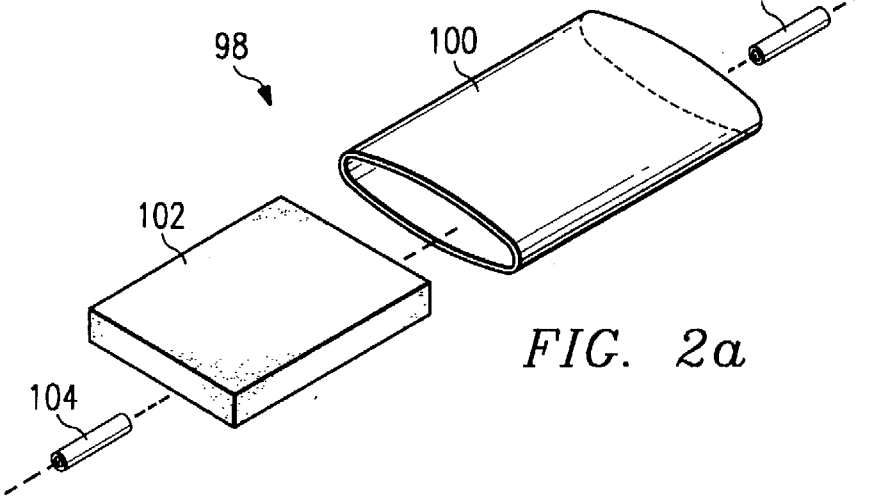
FIG. 2*a* illustrates an exploded diagram of the construction of the pump cells.

Referring now to FIG. 2*a*, there is illustrated an exploded diagram of the construction of a pump cell 98. The pump cell 98 consists of a plastic tube inlet 104, a plastic tube outlet 106, a main tubing 100 and an open-celled foam filler 102. Referring now to FIG. 2*b*, there is illustrated a cross-sectional view of an assembled pump cell 98. The plastic tube inlet 104 is shown inserted to the open-celled foam filler 102, which is inserted into the main tubing 100. The plastic tube outlet 106 is shown also inserted into the open-celled foam filler. Referring now to FIG. 2*c*, there is illustrated a perspective view of the pump cell 98. The open-celled foam filler 102 is shown inside the main tubing 100, with the plastic tube inlet 104 inserted through the main tubing 100 into the open-celled foam filler 102. The plastic tube outlet 106 is shown inserted into the open-celled foam filler 102 and through the main tubing 100.

In operation, the open-celled foam filler 102 is normally in an expanded position as shown in FIG. 2*b*, such that it holds the two sides of the main tubing 100 apart from each other. This in turn traps air in the open-celled foam filler 102. Air comes in through plastic tube inlet 104. The air may only flow inward through plastic tube inlet 104 and may only flow out through plastic tube outlet 106. When the main tubing 100 is compressed by a human foot (not shown), the open-celled foam filler 102 is compressed together and the two sides of the main tubing 100 move towards each other. This in turn causes the air inside the open-celled foam filler 102 to be expelled through the plastic tube outlet 106.

Figure 3A:
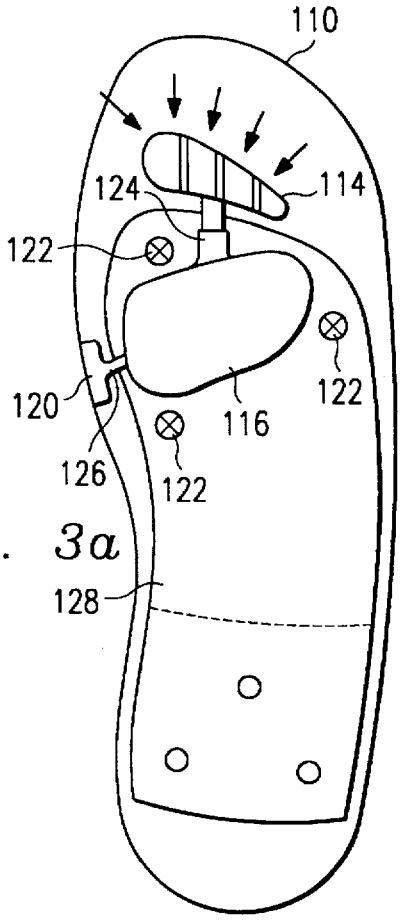
FIG. 3*a* illustrates an alternative embodiment of the present invention.
Figure 3B:
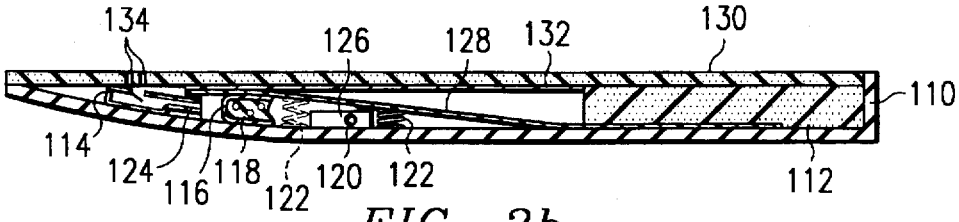
FIG. 3*b* illustrates a cross-sectional view of an alternative embodiment of the present invention.

Referring now to FIGS. 3*a* and 3*b*, there is illustrated an alternative embodiment of the present invention. An outer sole 110 is shown approximately in the shape of an outline of a human foot. A heel pad 112 is shown covering the rear one-third of the outer sole 110. An intake grille 114 is provided. A pump bladder 116 is provided and is filled with an open-celled foam 118. The pump bladder 116 is connected to the intake grille 114 through an inlet reed 124. An exhaust port 120 is provided and is connected to the pump bladder 116 through an outlet reed 126. A pump lever 128 is provided and runs from below the heel pad 112 up to the intake grill 114. Pump return springs 122 are provided and positioned between the outer sole 110 and the pump lever 128. The pump lever 128 is positioned such that it is directly above the pump bladder 116. A semi-rigid layer 132 is then positioned above pump lever 128 and a pad 130 is positioned above the heel pad 112 and the semi-rigid layer 132 running the full length of the outer sole 110 from the front of the outer sole 110 to the rear of the outer sole. Intake holes 134 are disposed in the pad 130 running through the full height of the pad 130.

In operation, when a human foot is not pressing upon the pad 130, this allows the open-celled foam 118 inside the pump bladder 116 to expand drawing air through intake holes 134 from around the toes of a human foot in through the intake grille 114 through the inlet reed valve 124 and into the pump bladder 116. When the human foot is pressed down on the pad 130, it pushes the semi-rigid layer 132 down upon the pump lever 128, which compresses the open-celled foam 118 in the pump bladder 116 and expels the air in the pump bladder 116 through the outlet reed 126 and then through the exhaust port 120. When pressure is released from the pump lever 128, the pump lever is raised by the pump return springs 122, such that the open-celled foam 118 in the pump bladder 116 may expand to draw in air.

Figure 4A:
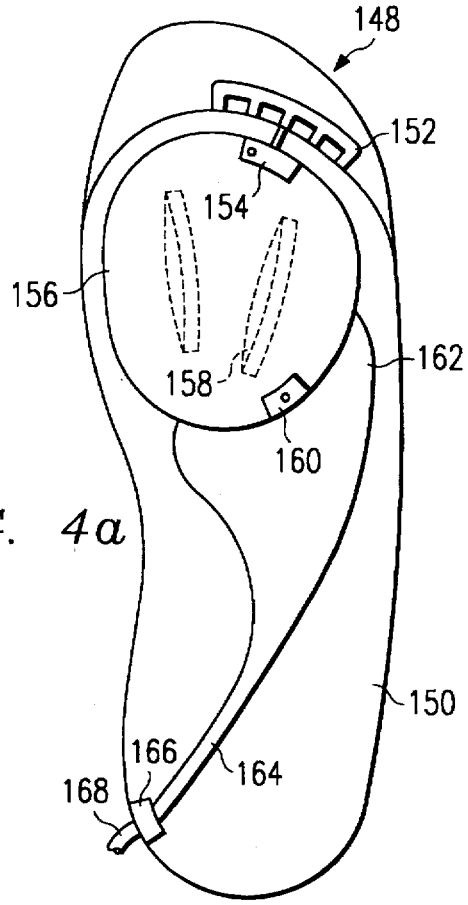
FIG. 4*a* illustrates a cut-away drawing of a shoe insert utilizing the system of the present invention.

Referring now to FIG. 4*a*, there is illustrated a cut-away drawing of a shoe insert 148 utilizing the system of the present invention. The shoe insert 148 consists of a base 150. The insert 148 also consists of an intake manifold 152. The intake manifold 152 is connected to a main pump cell 156 through an intake reed 154 which only allows air to travel from the direction of the intake manifold 152 to the main pump cell 156. The main pump cell 156 has semi-rigid walls and is expanded by leaf springs 158 disposed on the interior of the main pump cell 156. The main pump cell 156 is connected to a secondary pump cell 162 through a first exhaust reed 160 which allows air to flow only in the direction from the main pump cell 156 to the secondary pump cell 162. An exhaust tube 164 is connected to the secondary pump cell 162. The exhaust tube 164 has disposed near its end a second exhaust reed 166 allowing air to flow only from the secondary exhaust bladder 156 and not into the secondary exhaust bladder 156. Tube 168 is connected to the outward side of the second exhaust reed 166.

Figure 4B:
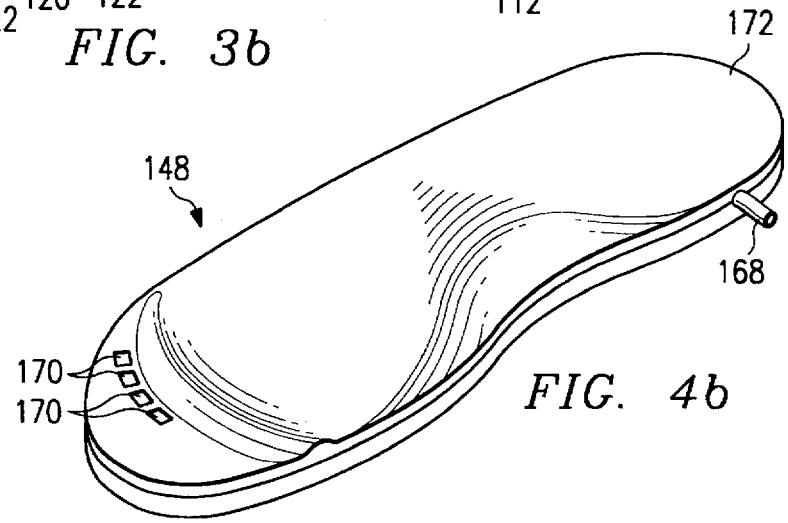
FIG. 4*b* illustrates a perspective view of the shoe insert utilizing the system of the present invention.

Referring now to FIG. 4*b*, there is illustrated a perspective view of the complete insert 148. A pad 172 is disposed over the full length of the base 150. Disposed in the pad 172 near the front of the pad 172 are intake holes 170. The intake holes 170 allow air from around the toes of the foot to travel through the pad 172 to the intake manifold 152.

In operation, the insert 148 can be disposed inside a normal athletic shoe between the foot of the wearer and the sole of the shoe. Once the insert 148 is inserted into a normal athletic shoe between the foot of the wearer (not shown) and the sole of the athletic shoe, the secondary pump cell 162 and the main pump cell 156 are filled with air. When a person first steps down with their heel, their foot presses the air out of the secondary pump cell 162 through the exhaust tube 164, out the second exhaust tube 166, and out the outlet tube 168. When a person rolls onto the ball of their foot, air is expelled from the main pump cell 156 through the exhaust reed 160 and into the secondary exhaust cell 162. When a person then completes their step and lifts their foot off of the ground, the leaf springs 158 in the main pump cell 156, expand the main pump cell 156 drawing air through the intake holes 170 from around the toes of the human foot (not shown) to the intake manifold 152 through the intake reed 154 and into the main pump cell 156. Then the cycle starts over again with the person expelling the air from the secondary pump cell 162 and then expelling the air from the cell 156 into the secondary exhaust cell 162 as stated above.

In summary, there has been provided an air-cooled shoe operable to ventilate the interior of the shoe and the area around a human foot. An outer sole having a toe portion, a ball portion and a heel portion is provided. A shoe upper is formed above the outer sole and is attached to the outer sole. A pump array is disposed above the ball portion of the outer sole, the pump array including an air-tight pump cell defined by a flexible material and filled with an open cell material which causes the pump cell to expand and fill with air, the pump cell having an air intake disposed on the toe portion of the outer sole and an air exhaust connected to the outside ambient air. A semi-rigid layer is disposed over the entirety of the pump array.

Although the preferred embodiment has been described in detail, it should be understood that various changes, substitutions and alterations can be made therein without departing from the spirit and scope of the invention as defined by the appended claims.

What is claimed is:

1. An air-cooled shoe operable to ventilate the interior of the shoe and the area around a human foot, comprising:

an outer sole having a toe portion, a ball portion and a heel portion;

a shoe upper formed above said outer sole and attached to said outer sole;

a pump array comprising multiple air tight pump cells disposed above said ball portion of said outer sole and in substantially the same plane, each of said pump cells defined by a flexible outer wall material and filled with an open cell foam material which causes each of said pump cells to expand and fill with air such that they are self-inflating with no external forces applied thereto, each said pump cell having an individual and separate air intake disposed on said toe portion of said outer sole and communicating with the interior of the shoe, and an individual and separate air exhaust connected to the outside ambient air, wherein each of said pump cells comprises means for allowing air to move only from said air intake to said air exhaust and in a substantially unrestricted flow from said air intake to said air exhaust; and a semi-rigid layer disposed over the entirety of said pump array such that when the ball portion of the human foot presses on said pump cells, one or more of said pump cells is compressed along with the ball portion of said outer sole and air is immediately pumped from the interior of the shoe to the outside ambient air, said semi-rigid layer of a rigidity that still allows compression of the ball portion of said outer sole.

2. The shoe of claim 1, wherein said air exhaust for each of said pump cells comprises an opening which is covered by a reed valve allowing air only to flow through said reed valve at a certain rate out of each of said pump cells providing a pneumatic suspension and cushioning of the foot.

3. The shoe of claim 1, wherein said air intake for each of said pump cells comprises an opening which is covered by a reed valve allowing air only to flow through said reed valve into the associated one of said pump cells.

4. The shoe of claim 1, wherein said pump array is activated by the pressure of a foot pressing against said semi-rigid layer and thereby compressing each of said pump cells, causing air to be expelled through said air exhaust in each of said pump cells.

5. The shoe of claim 1 and further comprising a pad placed over the full area of the outer sole.

6. A method of ventilating the interior of a shoe and the area around a human foot, comprising:

pumping air from the interior of a shoe into a pump array disposed above the ball portion of an outer sole of the shoe, the pump array including a plurality of air-tight pump cells each defined by a flexible material and filled with an open cell foam material which causes the associated pump cell to expand and fill with air, each of the pump cells having an individual and separate air intake disposed on the toe portion of the outer sole in communication with the interior of the shoe and an individual and separate air exhaust connected to the outside ambient air such that air flow from the air intake to the air exhaust is substantially unrestricted, the pump array including a semi-rigid layer disposed over the pump array; and immediately expelling air from each of the pump cells in the pump array using the pressure of the ball of the human foot on the semi-rigid layer proximate the ball portion of the outer sole to compress the open cell foam material in one or more of the pump cells along with the ball portion of the outer sole adjacent thereto and thereby immediately expel the air from the respective pump cells into the outside ambient air through the air exhaust.

7. The method of claim 6, wherein the air exhaust for each of the pump cells comprises an opening which is covered by a reed valve allowing air only to flow through the reed valve out of the associated pump cell at a certain rate providing a pneumatic suspension and cushioning of the foot.

8. The method of claim 6, wherein the air intake for each of the pump cells comprises an opening which is covered by a reed valve allowing air only to flow through the reed valve into the associated pump cell.

9. The method of claim 6 and further comprising the step of cushioning the area between the foot and the outer sole using a pad placed over the full area of the outer sole.

* * * * *

UNITED STATES PATENT AND TRADEMARK OFFICE

CERTIFICATE OF CORRECTION

PATENT NO. : 5,697,170
DATED : December 16, 1997
INVENTOR(S) : Mark D. Murrell and Rusty A. Reed It is certified that error appears in the above-indentified patent and that said Letters Patent is hereby corrected as shown below:

Column 4, line 19, delete "fight", and insert therefor --right--; and

Column 3, line 55, delete "them", and insert therefor --there--.

Signed and Sealed this

Thirtieth Day of November, 1999

*Attest:*

*Attesting Officer*

Q. TODD DICKINSON

*Acting Commissioner of Patents and Trademarks*